US007730582B2

(12) United States Patent
Migli

(10) Patent No.: US 7,730,582 B2
(45) Date of Patent: Jun. 8, 2010

(54) CUSHIONED HINGE HAVING A SHOCK ABSORBER MOUNTED ON THE INTERMEDIATE ELEMENT BETWEEN THE HINGE WING AND BASE TO BE FASTENED TO THE PIECE OF FURNITURE

(75) Inventor: Carlo Migli, Lecco (IT)

(73) Assignee: Agostino Ferrari S.p.A., Bergamo BG (IT)

( * ) Notice: Subject to any disclaimer, the term of this patent is extended or adjusted under 35 U.S.C. 154(b) by 404 days.

(21) Appl. No.: 11/907,887

(22) Filed: Oct. 18, 2007

(65) Prior Publication Data

US 2008/0098565 A1 May 1, 2008

(30) Foreign Application Priority Data

Oct. 30, 2006 (IT) ..... MI06A2085

(51) Int. Cl.
*E05F 1/08* (2006.01)
*E05F 3/20* (2006.01)
*E05F 5/02* (2006.01)

(52) U.S. Cl. ..... 16/286; 16/82; 16/254; 16/50

(58) Field of Classification Search ..... 16/286, 16/82, 83, 84, 85, 49, 50, 54, 68, 235, 239, 16/240, 254
See application file for complete search history.

(56) References Cited

U.S. PATENT DOCUMENTS 5,245,727 A * 9/1993 Sasaki ..... 16/240
5,930,883 A * 8/1999 McWhirt et al. ..... 16/235
6,591,454 B2 * 7/2003 Brustle ..... 16/54
7,096,535 B2 * 8/2006 Lin ..... 16/50
2008/0168620 A1 * 7/2008 Hammerle ..... 16/85

FOREIGN PATENT DOCUMENTS

EP 1199433 A2 4/2002
EP 1555372 A1 7/2005
JP 03197783 A * 8/1991
WO WO2005/108726 11/2005
WO WO2007/025316 3/2007

OTHER PUBLICATIONS

European Search Report dated Feb. 6, 2008.

* cited by examiner

*Primary Examiner*—Victor Batson
*Assistant Examiner*—Jeffrey O'Brien
(74) *Attorney, Agent, or Firm*—Jacobson Holman PLLC

(57) ABSTRACT

A hinge for connection of two furniture parts comprises a bowl-shaped element designed to be fastened to a first furniture part and a wing rotatably in engagement with said bowl-shaped element, the wing being adapted to be fastened to an intermediate element that, in turn, is fastened to a hinge base designed to be secured to a second furniture part, a shock absorber being present which comprises a body designed to be rigidly connected to said second furniture part and a shock absorbing member movably mounted on said body to restrain the closing movement of the hinge. The shock absorber body is mounted on the intermediate element of the hinge.

19 Claims, 3 Drawing Sheets

CUSHIONED HINGE HAVING A SHOCK ABSORBER MOUNTED ON THE INTERMEDIATE ELEMENT BETWEEN THE HINGE WING AND BASE TO BE FASTENED TO THE PIECE OF FURNITURE

BACKGROUND OF THE INVENTION

1. Field of the Invention

The present invention relates to an innovative cushioned hinge for furniture, which is for example adapted to prevent a furniture door from knocking against the frame with violence on closure.

2. State of the Prior Art

Manufacture of hinges provided with a shock absorber is known in the art, said shock absorber being designed to act between a hinge wing to be fastened to the furniture frame and a bowl-shaped element of the hinge, to be fastened to a suitable cavity in the furniture door.

There are several different shock absorbers, of the hydraulic or pneumatic type for example, and they are provided with a fixed body on which a movable shock absorbing member is mounted which is adapted to restrain the closing movement of the hinge.

According to one embodiment of the known art, the shock absorber body is fastened to the bowl-shaped element of the hinge and the shock absorbing member is such disposed as to come into contact with the wing during a closing step of the hinge to restrain a too quick and sudden movement of the door.

However, this solution has proved to be of reduced efficiency since the shock absorber, taking into account the arrangement and sizes of the common hinge pieces, is to be positioned and sized in a disadvantageous manner that does not allow a satisfactory cushioning or damping action to be developed between the hinge parts.

According to a further embodiment of the known art, as described in the European patent EP 1199433, the shock absorber body is directly mounted on the hinge wing so that it is parallel to the wing extension, the shock absorbing member being slideable in parallel to the wing.

While this arrangement of the shock absorber enables a better damping action to be achieved, it still has some non negligible disadvantages.

Actually, since the shock absorber is directly applied to the outside of the wing, it has a fitting point in the hinge that is easily accessible. In case of snap-fitting of the shock absorber in the wing, it may happen that the component unintentionally disengages from the hinge, during the furniture cleaning operations, for example.

In addition, when the hinge is of the adjustable type, the wing being fastened in an adjustable manner to an intermediate element snap-fitted into a hinge base to be fastened to the furniture frame, there is the risk of the intermediate element disengaging from the base giving rise to danger situations and possibly causing damages to the furniture structure. Actually, these adjustable hinges generally have an element for carrying out disengagement of the intermediate element that is easily accessible and can be unintentionally moved causing separation of the door from the frame and generating danger situations.

The present invention generally aims at eliminating the above mentioned drawbacks by providing a cushioned hinge capable of developing a satisfactory damping force on closure of the hinge and at the same time enabling a steady and safe mounting of the shock absorber to be obtained. It is a further aim of the invention to provide a cushioned hinge capable of being adjusted and enabling a high safety and reliability degree as regards mounting of its parts on the frame and the furniture door to be achieved.

SUMMARY OF THE INVENTION

In view of the above aim, in accordance with the invention, a hinge for connection of two furniture parts has been conceived which comprises a bowl-shaped element designed to be fastened to a first furniture part and a wing rotatably in engagement with said bowl-shaped element, the wing being adapted to be fastened to an intermediate element that, in turn, is fastened to a hinge base designed to be secured to a second furniture part, the intermediate element being interposed between the wing and base, a shock absorber being present which comprises a body designed to be rigidly connected to said second furniture part and a shock absorbing member movably mounted on said body to restrain the closing movement of the hinge, characterized in that the shock absorber body is mounted on the intermediate element of the hinge.

BRIEF DESCRIPTION OF THE DRAWINGS

For better explaining the innovative principles of the present invention and the advantages it offers over the known art, a possible embodiment applying such principles will be described hereinafter with the aid of the accompanying drawings. In the drawings.

DETAILED DESCRIPTION OF THE INVENTION

Figure 1:
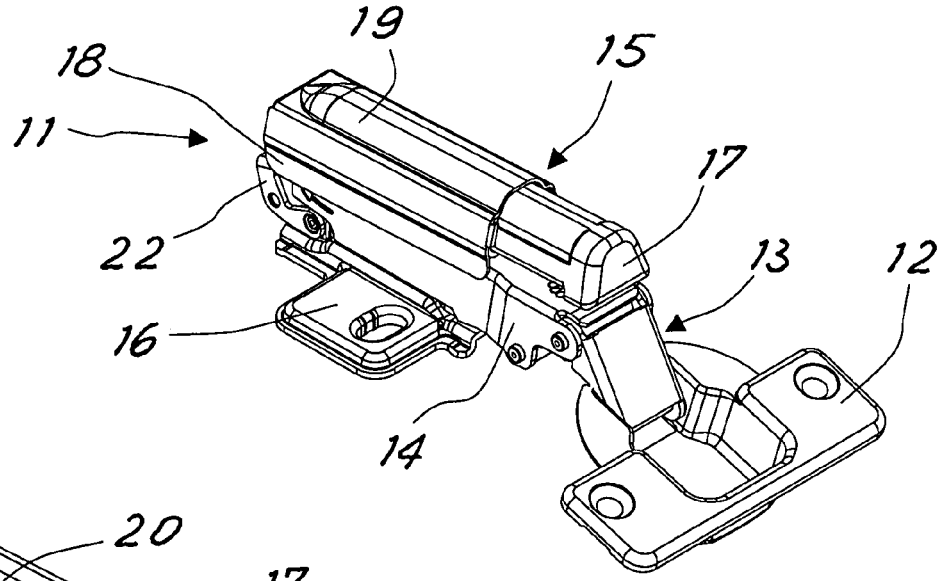
FIG. 1 is a perspective view of the hinge of the invention.

With reference to the drawings, a hinge 11 for furniture is shown in FIG. 1 and it comprises a bowl-shaped element 12 and a wing 14 rotatably in engagement with the bowl-shaped element. Engagement may take place through a known pivot system 13, of the articulated type for example. According to known techniques, the hinge can be provided with springs for automatic closure when the door is let free with an angle near the closed position on the frame.

The bowl-shaped element 12 has a pair of flanges provided with holes for fastening to a furniture part, a door of a wardrobe or cabinet for example, in which a cavity for receiving the bowl is formed.

Wing 14 is fastened in an adjustable manner to an intermediate element 26 (shown in FIG. 4), which in turn is secured to the hinge base 16. Base 16 is intended for fastening to a second furniture part, the fixed frame of a wardrobe or cabinet for example.

Hinge 11 is provided with a shock absorber 15, advantageously of the fluid-operated type, adapted to damp a sharp movement during the closure step of the hinge, to prevent the wardrobe door from knocking with violence against the frame, for example. According to a preferred embodiment of the invention, the shock absorber 15 can be of the hydraulic type.

Shock absorber 15 comprises a body 18 designed to be rigidly connected to the furniture part to which base 16 is fastened and a movable shock absorbing element 17 adapted to restrain movement of the other furniture part. Advantageously, the shock absorbing member 17 is such disposed as to contact the bowl-shaped element 12 during a closing step of the hinge. The shock absorber body 18 is secured to the intermediate element 26 preferably by snap-engagement, as better described in the following.

Body 18 forms a guide along which the shock absorbing member 17 can slide in a direction parallel to the longitudinal extension of wing 14.

In the embodiment shown in the figures, the shock absorber also comprises an outer shell 19 (FIG. 1) to be fastened to body 18 and adapted to cover and close the sliding region of the shock absorbing member 17.

Figure 2:
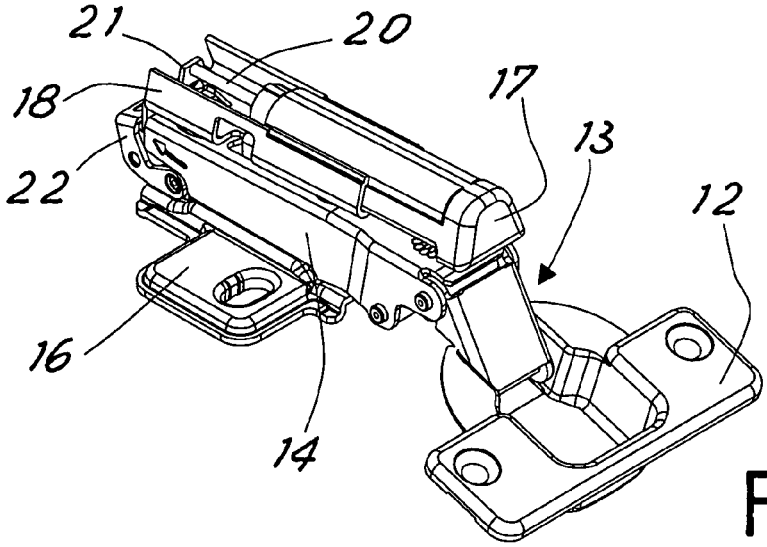
FIG. 2 is a view of the hinge shown in the preceding figure, where an outer shell of the shock absorber is removed.

The shock absorbing member comprises a movable head 17 forming a chamber inside which a piston slides which is integral with a rod 20 contacting the projection 21 of body 18 transverse to the longitudinal extension of the shock absorber (see FIG. 2, where the outer shell 19 of the shock absorber is removed). Head 17 is adapted to come into contact with the bowl-shaped element 12 to restrain the closing movement of the hinge.

Figure 3:
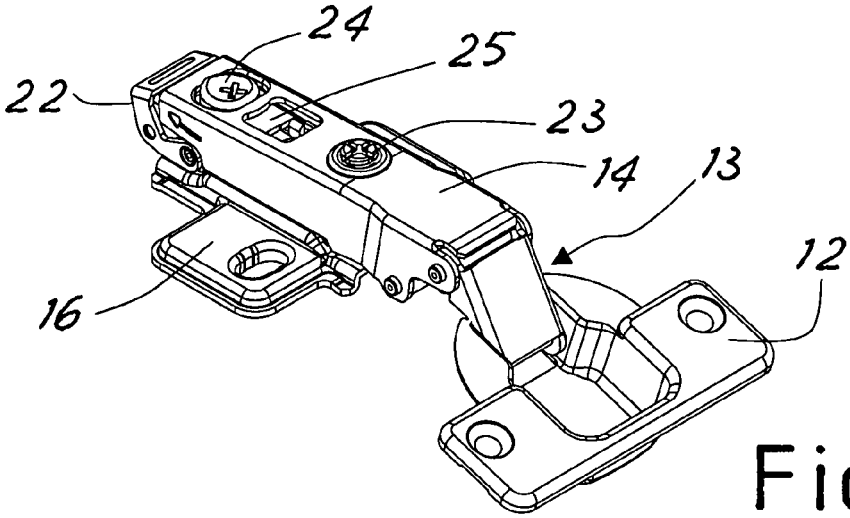
FIG. 3 is a view similar to the preceding ones, where the shock absorber is removed.

In FIG. 3 the hinge is represented with the shock absorber removed, and two screws 23 and 24 designed to fasten wing 14 of the intermediate element 26 of the hinge (shown in the following figures) are visible. According to known techniques, wing 14 can be fastened to the intermediate element in an adjustable manner, so as to enable the inclination relative to base 16 to be varied, or to allow a translation relative thereto, depending on requirements.

Also shown in FIG. 3 is an opening 25 on the upper part of wing 14; said opening, as clarified in the following, enables passage of fitting elements (or tongues 31) projecting from the shock absorber body 18 and engaging in a corresponding coupling seat in the intermediate element 26.

Figure 6:
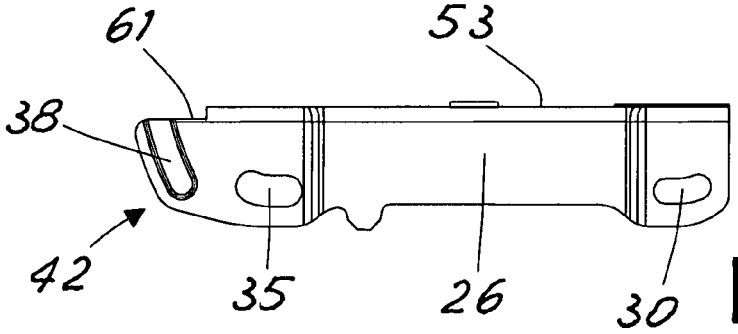
FIG. 6 is a side view of the intermediate element.
Figure 7:
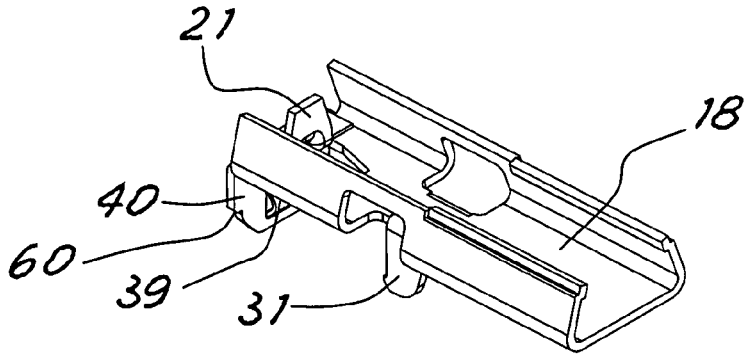
FIG. 7 is an exploded view of the hinge base, the intermediate element and the shock absorber body.
Figure 7:
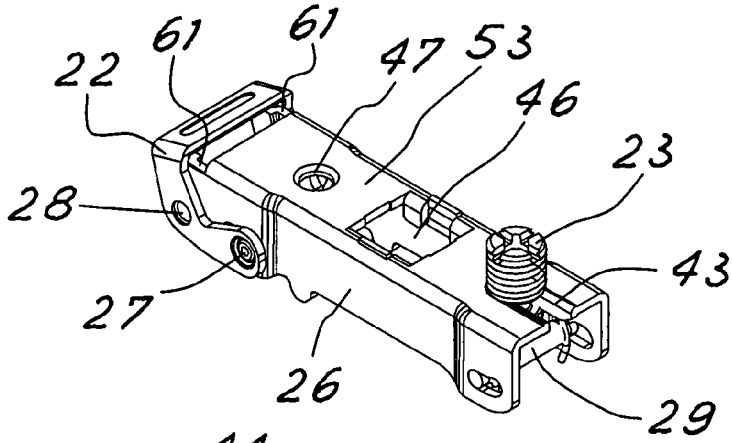
Figure 7:
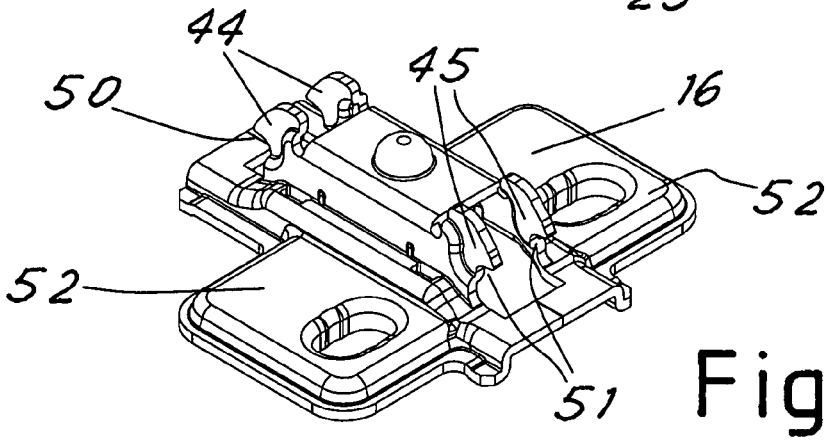
Figure 8:
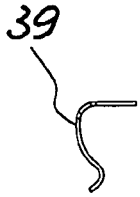
FIG. 8 is a side view of the fitting tongue of the shock absorber body.

The intermediate element 26 is advantageously fastened to base 16 by a snap-engagement. Base 16 is shown in FIG. 7 in the form of a plate provided, according to known techniques, with a pair of opposite side flanges 52 formed with holes for fastening to the furniture frame. Formed on plate 16 are projecting portions 44 forming an undercut fitting seat 50 for a fitting pin 27 (shown in FIG. 5, for example) mounted on the intermediate element. Similar projections 45 form a second undercut seat 51 for a second fitting pin 29 mounted on the intermediate element 26. The two pins 27 and 29 are movable relative to element 26 and can slide with their ends along slots 35 and 30 respectively (clearly shown in FIG. 6), formed in opposite sides of the intermediate element. Element 26, according to known techniques, has an elongated shape disposed almost parallel to wing 14 in use, and its cross section is generally U-shaped and open downwards in the direction of base 16. The two pins 27 and 29 are spring pushed to the engagement position with seats 50 and 51, so that they are tripped to the engagement position when the intermediate element 26 is pressed against the base. Pins 27 and 29 are pushed by springs 36 and 37 housed inside the intermediate element 26, according to known techniques.

Wing 14 too has a U-shaped cross section and embraces the intermediate element 26 in use position so as to cover said element.

The hinge is provided with means 22 for quick disengagement of the intermediate element 26 from base 16. The disengagement means comprises an operating element 22 adapted to act on pin 27 to enable release of base 16. Element 22 has an L-shaped conformation, seen laterally, and is provided with a pair of arms embracing the end of the intermediate element 26 on opposite sides. At the ends of the two arms, the operating element 22 is fastened to the opposite ends of the fitting pin 27 projecting from slots 35 in the intermediate element 26. In a middle position, the two arms of element 22 each comprise a projection 28 facing the intermediate element 26 and adapted to slide in a corresponding groove 38 externally formed on the side of the intermediate element 26 at its end 42 far from its pivotal mounting to bowl 12 (see FIG. 5). By manually moving the operating element 22 lifting it from the plane of base 16, pin 27 is moved along slot 35 against the action of the spring, so as to enable disengagement of the intermediate element 26 from base 16.

Figure 4:
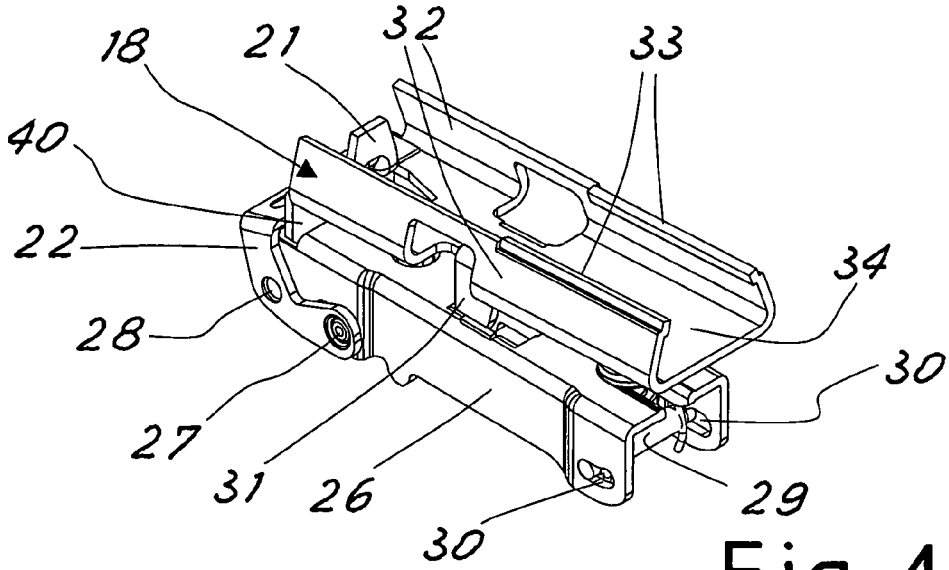
FIG. 4 is a view of the intermediate element of the hinge with the shock absorber body applied thereto.
Figure 5:
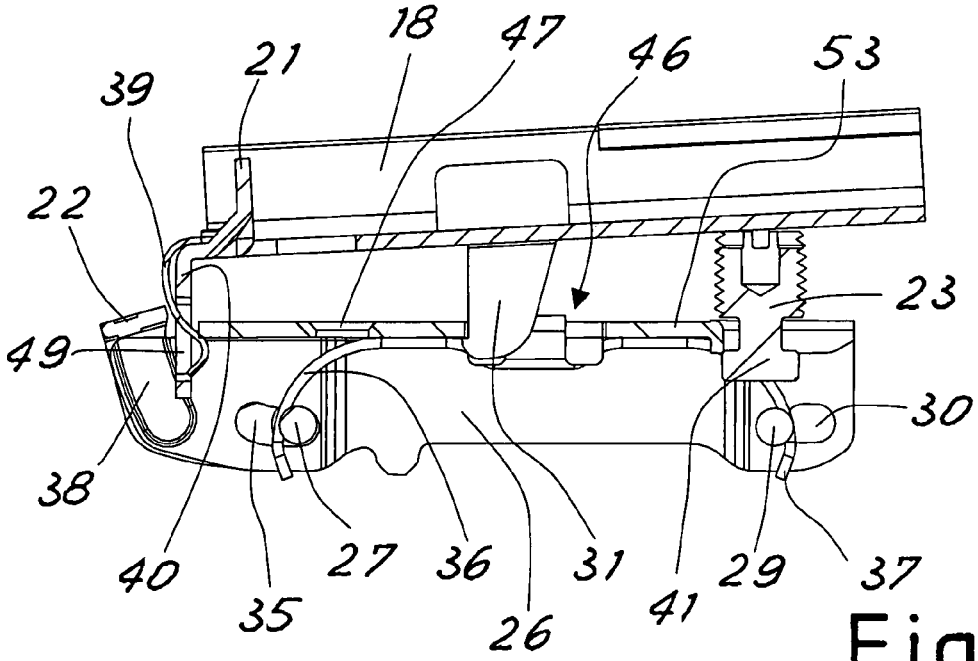
FIG. 5 is a longitudinal section view of the intermediate element of the hinge with the shock absorber body applied thereto.

Shown in FIGS. 4 and 5 is the shock absorber body 18 secured to the intermediate element 26 of the hinge, with wing 14 removed, which wing in use is disposed between the body 18 and upper wall 53 of the intermediate element 26.

Body 18 has a substantially U-shaped section with a bottom wall 34 and two side walls 32 forming the guide channel for sliding of the shock absorbing member 17. In the portion of body 18 that is the closest to bowl 12, the side walls 32 each have a rib 33 forming an undercut in which a corresponding groove formed in the shock absorber head 17 engages.

Projecting from body 18 is a pair of elements or tongues 31 (only one of which is shown in FIGS. 4 and 5) passing through opening 25 in the wing (shown in FIG. 3) for engagement in opening 46 formed in a middle position in the upper face of the intermediate element 26. Tongues 31 are provided with a hook at their lower end, for insertion under the upper wall 53 of the intermediate element 26, and have a flat shape oriented in parallel to the wing.

Figure 9:
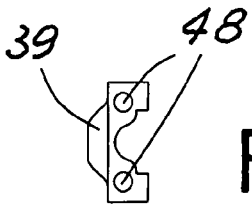
FIG. 9 is a top view of the tongue seen in FIG. 8.
Figure 10:
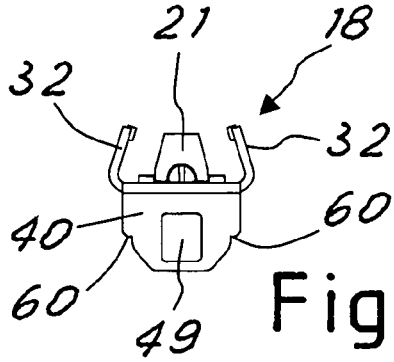
FIG. 10 is a front view of the shock absorber body.

Close to its end far from bowl 12, body 18 is provided with a wall 40 jutting out transversely downwards in the direction of the intermediate element and a flexible tab 39 also jutting out downwards and secured to the shock absorber body 18. Tab 39 engages in an undercut formed by wall 53 at the end of the intermediate element 26. Tab 39 projects towards the inside of element 26 through an opening 49 (clearly shown also in FIG. 10) formed in wall 40 of body 18, and is fastened to body 18 at the two upper fastening holes 48 shown in FIG. 9.

Body 18, pushed by the action of the spring tab 39 rests on the intermediate element 26 with the two surfaces 60 formed on opposite sides of wall 40 and adapted to rest on the two teeth 61 projecting rearwardly from the side walls of the intermediate element 26 (see FIGS. 4 and 7).

Body 18 of the shock absorber, when applied to the hinge, rests on the head of screw 23 which is designed to fasten wing 14 to the intermediate element 26 in an adjustable manner; according to known techniques, the position of screw 23 can be varied along groove 43 formed in the back of the intermediate element 26, clearly shown in FIG. 7. Also shown in FIGS. 5 and 7 is hole 47 in the upper wall 53 of the intermediate element, which is designed to receive a second screw for fastening of wing 14, according to techniques known in the art.

Due to the particular type of fastening of body 18 to the intermediate element 26, under operating conditions the fitting points of the shock absorber 15 in the hinge are covered by the wing and are hardly accessible in an accidental manner; anchoring of the shock absorber to the hinge is thus reliable and efficient.

In addition, when the shock absorber is applied to the hinge, operation of the disengagement means of the intermediate element from base 16 is inhibited. Actually, the operating element 22 cannot be lifted in order to bring pin 27 out of engagement with its seat 50 due to the presence of tab 39 and of the shock absorber body 18, so that undesirable accidental separations between intermediate element 26 and base 16 can be avoided, which separations could easily cause damages to persons or things.

To carry out separation of the intermediate element 26, it is first necessary to remove shock absorber 15 from the hinge, thus providing a high safety level.

At this point it is apparent that the aims of the present invention are achieved.

In particular, a cushioned hinge is provided which enables a sufficient damping force to be developed while at the same time being highly reliable.

In fact, the risk of undesirable accidental separations of the shock absorber from the hinge or of the intermediate element from the hinge base are reduced to a minimum.

In addition, the hinge allows a quick and easy mounting of the shock absorber as well as adjustment of the wing position relative to the base, while having a simple and cheap structure.

Obviously, the above description of an embodiment applying the innovative principles of the present invention is given by way of example only and therefore must not be considered as a limitation of the scope of the patent rights herein claimed.

For instance, also different types of shock absorbers could be used, optionally with a different arrangement of the shock absorbing member. A pneumatic shock absorber instead of a hydraulic shock absorber as previously described could be also used.

What is claimed is:

1. A hinge for connection of two furniture parts comprising a bowl-shaped element for fastening to a first furniture part and a wing rotatably in engagement with said bowl-shaped element, the wing fastened to an intermediate element that, in turn, is fastened to a hinge base for securing to a second furniture part, the intermediate element being interposed between the wing and base, a shock absorber being present which comprises a body for rigidly connecting to said second furniture part and a shock absorbing member movably mounted on said body to restrain the closing movement of the hinge, wherein the shock absorber body is mounted on the intermediate element of the hinge, further comprising a disengagement means for quick disengagement of the intermediate element from the base, wherein operation of said disengagement means is inhibited when the shock absorber is mounted on the intermediate element to prevent unintentional separation of the intermediate element from the hinge base.

2. A hinge as claimed in claim 1, wherein the wing can be fastened to the intermediate element in an adjustable manner.

3. A hinge as claimed in claim 1, wherein the shock absorber body is mounted on the intermediate element by snap-engagement.

4. A hinge as claimed in claim 1, wherein the shock absorber body stands above the wing that is interposed between the shock absorber body and the intermediate element.

5. A hinge as claimed in claim 4, wherein the shock absorber body comprises a fitting means for fitting in the intermediate element, said fitting means passes through openings formed in the wing.

6. A hinge as claimed in claim 5, wherein said fitting means comprises tongues suitable for engagement in an opening formed in the intermediate element at a middle position relative to its longitudinal extension, the shock absorber body being provided with a flexible tab suitable for snap-engagement in the intermediate element at an end thereof that is far from the bowl-shaped element.

7. A hinge as claimed in claim 1, wherein the shock absorber is fluid-operated.

8. A hinge as claimed in claim 1, wherein the shock absorber body forms a guide on which the shock absorbing member slides.

9. A hinge as claimed in claim 8, wherein the shock absorber is fluid-operated and the shock absorbing member comprises a head that is movable relative to the shock absorber body and is adapted to contact the bowl-shaped element during a closing step of the hinge, a chamber being formed in the head and a piston rigidly connected to a rod sliding within said chamber, the rod contacting a plane of the body which is transverse to its longitudinal extension.

10. A hinge as claimed in claim 1, wherein the shock absorber has an extension parallel to the extension of the wing and the intermediate element, the movement direction of the shock absorbing member being parallel to the wing.

11. A hinge as claimed in claim 1, wherein the intermediate element is fitted in the hinge base by snap-engagement.

12. A hinge as claimed in claim 11, wherein the intermediate element can be snap-fitted into the base through a fitting pin movably mounted on the intermediate element and spring-pushed for engagement in a corresponding seat formed in the hinge base.

13. A hinge as claimed in claim 12, wherein said disengagement means comprises an operating element movably mounted on the intermediate element and manually drivable to move said fitting pin from an engaged position to a disengaged position of the base against the action of a spring acting between the pin and the intermediate element.

14. A hinge as claimed in claim 13, wherein said operating element seen laterally has an L-shaped conformation and is provided with two arms embracing one end of the intermediate element, respective guide projections being present at a middle position of each of the two arms, which projections are adapted to slide in corresponding grooves externally formed at the sides of the intermediate element, at the ends of the two arms the operating element being secured to the pin for engagement of the intermediate element with the base.

15. A hinge as claimed in claim 12, wherein the intermediate element is also provided with a second movable engagement pin that is spring-pushed for engagement in a second seat formed in the hinge base.

16. A hinge as claimed in claim 15, wherein the intermediate element has a U-shaped cross-section, said fitting pins being received at the ends into corresponding pairs of elongated slots formed in the opposite sides of the intermediate element.

17. A hinge as claimed in claim 1, wherein the shock absorber body rests on the head of a fastening screw to secure the wing to the intermediate element.

18. A hinge as claimed in claim 1, wherein the shock absorbing member is adapted to contact the bowl-shaped element during a closing step of the hinge.

19. A hinge as claimed in claim 1, wherein the hinge wing has a U-shaped cross section and in use covers the intermediate element.

* * * * *